United States Patent [19]

Vanderbeck

[11] Patent Number: 4,494,331

[45] Date of Patent: Jan. 22, 1985

[54] FIREARM SAFETY DEVICE

[75] Inventor: William E. Vanderbeck, Ridgefield Park, N.J.

[73] Assignee: The United States of America as represented by the Secretary of the Army, Washington, D.C.

[21] Appl. No.: 459,740

[22] Filed: Jan. 21, 1983

[51] Int. Cl.[3] ..... F41C 11/02

[52] U.S. Cl. ..... 42/70 D; 42/69 A

[58] Field of Search ..... 42/69 A, 70 R, 70 C, 42/70 D, 70 E, 1 A; 89/148

[56] References Cited

U.S. PATENT DOCUMENTS

| | | | |
|---|---|---|---|
| 2,785,605 | 3/1957 | Jourdat | 42/69 A X |
| 3,010,237 | 11/1961 | Colby | 42/69 A X |
| 3,397,474 | 8/1968 | Badali | 42/70 D |
| 3,447,525 | 6/1969 | Cermak et al. | 42/69 A |
| 3,566,527 | 3/1971 | Silsby | 42/1 F |
| 3,609,901 | 10/1971 | Necas | 42/1 M X |
| 3,950,876 | 4/1976 | Wild et al. | 42/69 A |
| 4,422,254 | 12/1983 | McQueen | 42/70 D X |

*Primary Examiner*—Peter A. Nelson

*Attorney, Agent, or Firm*—Anthony T. Lane; Robert P. Gibson; Michael C. Sachs

[57] ABSTRACT

The present invention discloses a simplified firearm safety device for an open bolt type automatic firearm. The safety device includes operating means and an apparatus having a freely rotatable sear pivotally mounted at a base of the apparatus in an oblong slot and a safety pin in a defined position in the sear which prevents unintentional discharge and precludes safety engagement when the weapon is not properly charged. The relative movement of the pivot pin with respect to safety pin holes in the sear insure that the unintentional discharge is prevented as well as the weapon is fired only when it is properly charged.

1 Claim, 3 Drawing Figures

FIREARM SAFETY DEVICE

GOVERNMENTAL INTEREST

The invention described herein may be manufactured, used and licensed by or for the Government for Governmental purposes without the payment to me of any royalties thereon.

BACKGROUND OF THE INVENTION

The present invention relates to a field of art dealing with firearm safety devices. The fundamental function of a firearm safety device is to prevent accidental discharge of a weapon while it is loaded. Further, in an automatic weapon which operates in an "open bolt" or "rear seared" mode, it is necessary to prevent the safety device from being engaged unless the weapon is charged. The basis of this requirement is outlined below.

An open bolt firearm is that class of weapon in which firing is limited by holding the weapon's operating group near its rearmost position with a hook like projection called a sear, thus stopping the weapon with it's bolt open. The operating group is the reciprocating portion of a weapon's mechanism which accomplishes the mechanical actions necessary to produce automatic fire.

The basic shortcoming in prior art devices is related to an absence of a device that can prevent two undesirable possibilities in the use of an open bolt automatic firearm.

These possibilities occur if the safety, a device to prevent the sear from releasing the operating group and thus initiating firing, is engaged while the operating group is not at it's rearmost position. The weapon operator next attempts to manually pull the operating group to it's rear position in preparation for firing. This manual operation is required by the weapon's cycle of operation and is referred to as charging. As the sear is locked by the safety, it cannot move to allow the operating group to pass by and be hooked by the sear. At this point several things may happen.

Firstly, the operator may realize that the weapon is not completely charged and may apply excessive force in an attempt to complete charging. Excessive force may break mechanism parts and result in uncontrollable firing.

Secondly, the operator may not realize that charging is incomplete and may release the charging handle. Such action would permit a shot to be fired after which the automatic cycling of the operating group would break mechanism parts and again result in uncontrollable firing.

Accordingly, the present invention is intended as a solution to both undesirable and unsafe possibilities.

SUMMARY OF THE INVENTION

The present invention discloses a simplified firearm safety device for an automatic firearm. This safety device includes means to insure that unintentional discharge is prevented as well as that the safety device can be operated only when the weapon is properly charged. The present safety device comprises a sear means having a base and a freely rotatable arm pivotally mounted wherein one end of the arm is in engagement with a mating projection of the weapon operating means. The base of the sear means comprises an oblong slot which permits the longitudinal movement of the arm when the operating means is actuated as well as not actuated. The safety device also includes a sear block which coordinates with the pin on which the sear means pivots so that the safety pin holes align only when the weapon is properly charged. The present invention precludes the possibility of damaging parts of the mechanism of a firearm by preventing the operator from engaging the safety device unless the weapon is fully charged.

It is an object of the present invention to provide a simplified and reliable firearm safety device.

It is another object of the present invention to provide a firearm safety device which is capable of preventing uncontrolled, unintentional discharge of a weapon.

It is a further object of the present invention to provide a firearm safety device which provides a mechanism by which the safety can be engaged only when the weapon is properly charged.

DESCRIPTION OF THE PREFERRED EMBODIMENTS

A general understanding of the present invention may be obtained with respect to the drawings.

Figure 1:
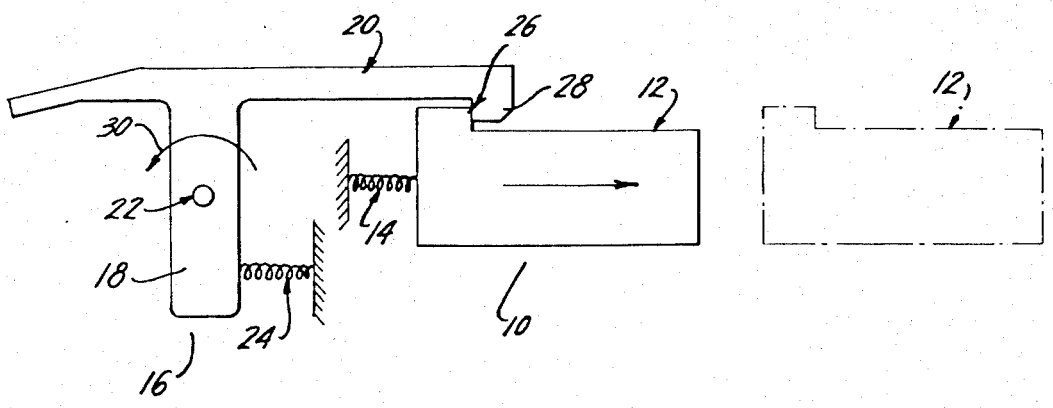
FIG. 1 represents a simplified schematic view of a prior art firing control mechanism for an open bolt type automatic firearm.

As shown in the prior art, FIG. 1 shows open bolt weapon firing control mechanism 10 without a safety for an open bolt type automatic firearm comprises operating means 12 having a first spring 14 mounted at one end and an apparatus 16 having a base 18 connected to a rotatable arm or a sear 20. Apparatus 16 is rotatable about pivot pin 22 and has a second spring 24 mounted at one end of base 18. Arm 20 has a hook projection 28 which engages a mating shoulder surface 26 of the operating means 12. The pivot pin 22 is positioned along the vertical axis of the base which is perpendicular to the direction of the movement of the arm 20. Hook 28 prevents operating means 12 from moving in the direction of arrow 29 under the force of the first spring 14. If a torque is applied to sear 20 in the direction of the curved arrow 30 as to rotate it about pivot pin 22, the operating means 12 is permitted to move to the right which initiates the firing cycle. The second spring 24 acts to return sear 20 to a horizontal position to catch operating means 12 when the actuating force is removed from sear 20.

This mechanism has no safety. The two undesirable possibilities mentioned would only be present if some form of manually engaged device were added to FIG. 1 to prevent rotation (30). Such a device would constitute a safety.

Figure 2:
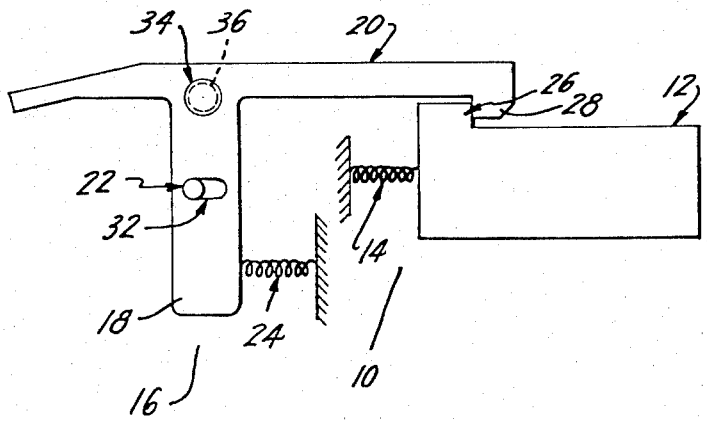
FIG. 2 represents a simplified schematic view of an improved firing control mechanism for an open bolt type automatic firearm in a 'charged' position.
Figure 3:
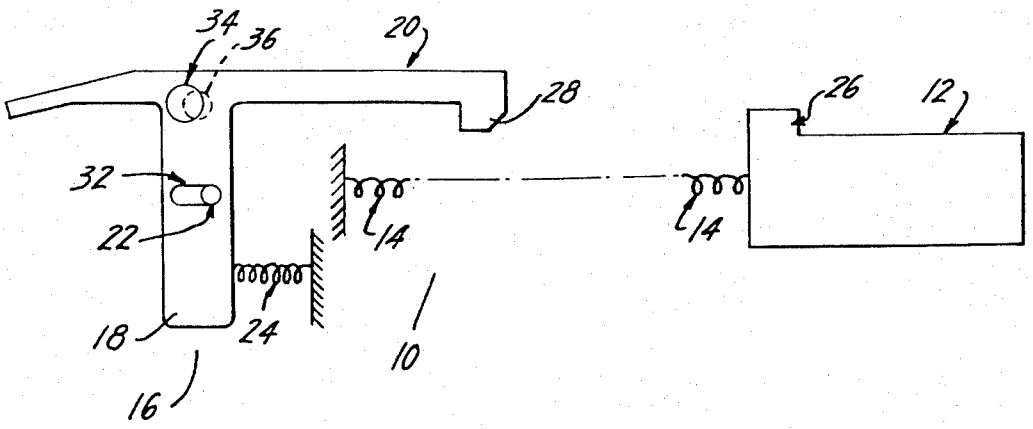
FIG. 3 represents an improved simplified firing control mechanism for an open bolt type automatic firearm in a 'discharged' position.

FIG. 2 shows a firearm safety device similar to that as shown in FIG. 1 with certain exceptions to rectify the shortcomings as discussed hereinbefore. The base 18 is provided with portions defining an oblong shaped plot 32 which permits the sear 20 to move in a horizontal direction. When mating projection 26 of the operating means 12 is not engaged by a hook projection 28 of sear 20 as shown in FIG. 3, the sear 20 is pushed to the left by the force of second spring 24. However, when the operating means 20 is caught by hook 28, as shown in FIG. 2, sear 20 moves horizontally to the right by virtue of the fact that the force applied to the operating means 12 here represented by first spring 24. A sear block such as a pin 36 and its pin hole 34 are so situated that they will line up only when the sear 20 has moved to the right relative to its pivot pin 22 as in FIG. 2. In this alignment, sear block pin 36 may be entered lengthwise into hole 34, thus blocking sear 20 and rendering the weapon "safe".

As shown in FIG. 3, when the sear has moved left relative to its pivot pin 22, the safety pin 36 and hole 34 no longer align. Thus, insertion of sear block pin 36 into hole 34 is prevented unless the weapon is properly charged.

Accordingly, while there have been shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

I claim:

1. A firearm safety device for an automatic firearm which comprises:

(a) means for operating the firearm; a first spring mounted at one end of said means for operating the firearm for urging longitudinal movement of the operating means, said longitudinal movement initiating firing of the firearm;

(b) sear means having a base with an oblong shaped slot therein, a freely rotatable arm pivotally mounted at the base, having a pivot pin along its vertical axis perpendicular to the direction of the movement of the arm and having one end of the arm in engagement with a mating surface of the operating means;

(c) a second spring at one end of the base controlling a horizontal movement of the sear means whereby the operating means is actuated by the movement of the horizontal arm of the sear means in order to cause firing of the firearm; and (d) a safety pin aligned to a position relative to the movement of the pivot pin in said oblong slot so that the safety may be actuated only if the weapon is properly charged, the said arm moving under a force of the said second spring when the operating means is not actuated by the arm, said horizontal arm moving in an opposite direction under a force of said first spring when the operating means is actuated by said arm of the sear means.

* * * * *